US009598904B2

(12) United States Patent
Aldred et al.

(10) Patent No.: US 9,598,904 B2
(45) Date of Patent: Mar. 21, 2017

(54) METHOD FOR TORQUE STABILIZATION OF A DRILLING SYSTEM

(75) Inventors: Walter Aldred, Thriplow (GB); Ashley Johnson, Milton (GB); Dean Gardner, Selsdon (GB); Maurice Ringer, Bracken Ridge (AU); Devi Putra, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 830 days.

(21) Appl. No.: 13/517,953

(22) PCT Filed: Nov. 8, 2010

(86) PCT No.: PCT/IB2010/002858
§ 371 (c)(1),
(2), (4) Date: Jan. 7, 2013

(87) PCT Pub. No.: WO2011/077201
PCT Pub. Date: Jun. 30, 2011

(65) Prior Publication Data

US 2013/0105220 A1 May 2, 2013

(30) Foreign Application Priority Data

Dec. 22, 2009 (GB) ..... 0922347.0

(51) Int. Cl.
*E21B 7/06* (2006.01)
*E21B 7/04* (2006.01)
*E21B 17/10* (2006.01)

(52) U.S. Cl.
CPC ..... *E21B 7/04* (2013.01); *E21B 7/06* (2013.01); *E21B 7/068* (2013.01); *E21B 17/1078* (2013.01)

(58) Field of Classification Search
CPC ... E21B 7/04; E21B 7/06; E21B 7/068; E21B 17/1078
See application file for complete search history.

(56) References Cited

U.S. PATENT DOCUMENTS 5,094,304 A 3/1992 Briggs
5,316,093 A 5/1994 Morin et al.
(Continued)

FOREIGN PATENT DOCUMENTS

EP 1143105 A8 4/2002

OTHER PUBLICATIONS

Combined Search and Examination Report of British Application No. GB 0922347.0 dated Mar. 30, 2010.
(Continued)

*Primary Examiner* — Giovanna C Wright

(57) ABSTRACT

A drill string suitable for use in directional drilling of a borehole, comprising a rotatable shaft at the leading end of which is a drill bit, and wherein the shaft comprises a variable friction inducing member, which provides rotational friction by physical contact with an inside face of the borehole, the friction inducing member being arranged to exert a first rotational frictional force when the shaft in the vicinity of the member is substantially rotating and a second rotational frictional force when the shaft in the vicinity of the member is substantially not rotating, wherein the first rotational frictional force is less than the second rotational frictional force.

7 Claims, 3 Drawing Sheets

(56) References Cited

U.S. PATENT DOCUMENTS

| | | | | |
|---|---|---|---|---|
| 5,419,405 | A * | 5/1995 | Patton | 175/27 |
| 5,520,256 | A * | 5/1996 | Eddison | E21B 7/068 175/61 |
| 5,655,609 | A * | 8/1997 | Brown | E21B 17/1021 175/325.1 |
| 6,050,348 | A | 4/2000 | Richarson et al. | |
| 6,142,245 | A | 11/2000 | Best | |
| 6,213,226 | B1 * | 4/2001 | Eppink | E21B 7/064 175/61 |
| 6,571,888 | B2 | 6/2003 | Comeau et al. | |
| 7,096,979 | B2 | 8/2006 | Haci et al. | |
| 2003/0056991 | A1 | 3/2003 | Hahn et al. | |
| 2007/0151767 | A1 | 7/2007 | Downton | |
| 2008/0000693 | A1 | 1/2008 | Hutton | |

OTHER PUBLICATIONS

International Search Report of PCT Application No. PCT/IB2010/002858 dated Jun. 3, 2011.

* cited by examiner

METHOD FOR TORQUE STABILIZATION OF A DRILLING SYSTEM

CROSS-REFERENCE TO RELATED APPLICATIONS

This application is a United States National Stage Application under 35 U.S.C. §371 and claims priority to PCT Application Number PCT/IB2010/002858 filed Nov. 8, 2010 which claims priority to British Patent Application Serial Number 0922347.0 filed Dec. 22, 2009. Both of these applications are incorporated herein by reference in their entireties.

TECHNICAL FIELD

The present invention relates to a drillstring system for use in a drilling system for drilling a borehole through an Earth formation.

BACKGROUND

Vertical drilling into the earth, in an attempt to access oil and gas reserves, is a relatively straightforward operation. A drillstring comprising a drill bit at its end is rotated from the surface, such rotation powering the drill bit to cut into the earth. Typically so-called drilling muds are passed down the inside of the drill bit, which exit at the cutting face of the drill bit. These muds cool the drill bit, keep it lubricated and carry away the cuttings as they flow upwards in the annulus between the drillstring and the inside face of the drilled borehole.

However, if it is desired to change drilling direction, then so-called directional drilling is required, which is more technically challenging.

A common method of inducing a change in drilling direction is for the drillstring to include a slight bend of a few degrees near to the drill bit. By rotating the shaft, the drill bit can be "pointed" in the desired direction. Because it is desirable to maintain the drill bit pointed in a specified direction, a motor is provided to power the drill bit when the shaft is not rotating. The shaft is then held in position in a non-rotating manner, whilst the motor rotates the drill bit. Such a drilling mode is often called "sliding drilling" as the shaft of the drillstring effectively slides into the ground without rotating.

In this common arrangement, once the trajectory of the drill has deviated sufficiently, regular drilling in a straight line can be resumed by initiating rotation of the drillstring. This has the effect that the slight bend in the shaft begins to rotate and the net result is drilling in a straight line. Such a drilling mode is often called "rotary drilling".

Thus, by moving between sliding drilling and rotary drilling modes the trajectory of drilling can be controlled.

However, in practice, this approach is fraught with difficulties.

Firstly, if the reactionary force on the drill bit changes significantly, as often happens, then this is transmitted, as "reactive torque" to the drillstring. This has the effect of the drillstring rotating near the drill bit, causing the drill bit to veer off from its target direction.

Secondly, as the lengths of the drillstring may be several kilometers, a substantial length will be in frictional contact with an inside face of the borehole. This makes correcting any deviation of the drill bit from its target direction by rotating the drillstring at the surface particularly difficult, as such rotations are often not transmitted to the drillstring at all and are instead stored in the shaft as rotational strain energy.

Such friction also makes it difficult to control the weight applied to the drill bit during sliding drilling. Additional weight applied to the drillstring at the surface can simply be absorbed by the drillstring as compressive strain energy, and in an extreme case providing no change to the weight applied to the drill bit.

This can result in an eventual release of stored compressive strain energy, which can result in a significant overshoot in the weight applied to the drill bit. This can damage the drill bit or cause it to stall, shortening the life of the bit and making the drilling operation take longer, both of which significantly increase the cost of drilling.

Methods of reducing the effect of friction during sliding drilling are known. For example U.S. Pat. No. 6,050,348 teaches "rocking" the drillstring at the surface to a specified angle to reduce the friction between the drillstring and an inner face of the borehole. Another method disclosed in U.S. Pat. No. 7,096,979 teaches "sliding" the drillstring by rotating the drillstring at the surface back and forth between specified torque limits. This is claimed to reduce wall friction during sliding drilling and therefore improve control of the direction of the drill bit and the weight applied to the bit.

However, even with these methods, significant deviations in drilling direction and lack of control of weight on bit are encountered during sliding drilling.

Moreover, downhole motors may be used in different types of drilling operations and the action of the downhole motor in rotating the bit/bottomhole assembly may cause a torque reaction from the operation of the downhole motor that may cause twisting of the drillstring and/or tool face instability.

SUMMARY

The present invention relates to a drillstring suitable for use in directional drilling of a borehole, comprising a rotatable shaft at the leading end of which is a drill bit, and wherein the shaft comprises a variable friction inducing member, which provides rotational friction by physical contact with an inside face of the borehole, the friction inducing member being arranged to exert a first rotational frictional force when the shaft in the vicinity of the member is substantially rotating and a second rotational frictional force when the shaft in the vicinity of the member is substantially not rotating, wherein the first rotational frictional force is less than the second rotational frictional force.

In the situation during sliding drilling when the drill bit encounters a change in reactionary force, which is transmitted to the shaft as reactive torque, the shaft is prevented from rotating by the high rotational frictional force provided by the friction inducing member. Thus, any deviation from the target direction is minimised, enabling known corrective action to be more effectively applied.

Thus, the invention is highly counter-intuitive as it involves the introduction of a friction inducing member as the solution to the problem caused by existing friction.

Additionally, during rotary drilling, when the shaft is forced to rotate from the surface, the frictional member does not impede the rotation of the shaft in view of its low rotational friction during shaft rotation.

Thus, by "substantially rotating" means the rotary movement typically encountered during rotary drilling, i.e. continuous rotating movement over many revolutions e.g. at from 50 to 200 rpm. By "substantially not rotating" refers to the minor rotations of the shaft encountered during sliding drilling which are rotations of less than one revolution. In a preferred embodiment, "substantially not rotating" can mean that the shaft is not rotating.

Additionally, "in the vicinity" typically means within 100 m, preferably within 50 m, more preferably within 20 m.

It may therefore be seen that the reactive torque transmitted to the shaft during sliding drilling is insufficient to overcome the high rotational friction of the variable frictional inducing member, whereas the torque transmitted to the shaft from the surface during rotary drilling is sufficient to overcome the high rotational friction of the variable frictional inducing member, which then switches to its low rotational friction mode so that it does not impede rotary drilling.

Thus, preferably the second rotational friction force, measured as torque, has a value of at least 300 Nm, more preferably at least 600 Nm, even more preferably at least 800 Nm. Such a static frictional force, or stiction, should be sufficient to prevent rotation of the shaft in the vicinity of the friction inducing member.

Likewise, preferably the first rotational friction force has a value of less than 500 Nm, preferably less than 300 Nm, more preferably less than 150 Nm, most preferably substantially zero. Provided of course that the first rotational friction force is less than the second frictional force.

Typically therefore, the ratio of the second frictional force to the first frictional force is at least 2:1, preferably at least 4:1, more preferably at least 10:1.

Typically the drillstring comprises a motor, e.g. a mud motor, to power the drill bit.

The drillstring also comprises a direction altering means, such as a bend in the shaft near the drill bit of a few degrees, e.g. from 0.5° to 3°.

Preferably the variable friction inducing member is located near to the drill bit, as its ability to minimise deviation of the drill bit from the target direction deteriorates the further away from the bit it is located, due to the elasticity of the drillstring. Thus, preferably the friction inducing member is less than 500 m, more preferably less than 250 m, most preferably less than 100 m from the drill bit.

The variable friction inducing member may take a number of forms, however in a first preferred embodiment the friction inducing member comprises a passive arrangement.

A passive friction inducing member involves a component which circumscribes a diameter greater than that of the shaft but less than that of the diameter of the borehole. Such passive components are typically rigidly attached, or integrally formed with, the shaft.

It has been found that if such passive components comprise a barb-like protrusion for engagement with an inside surface of the borehole then the passive component is particularly effective. Suitable protrusions include sharp edges or cutters. When stationary, such barb-like protrusions cut into the surface of the borehole thus providing a high level of static friction, or stiction. When rotating they do not have the opportunity to cut into the surface and thus produce much less rotational friction whilst the shaft in the vicinity of the passive frictional member is substantially rotating.

Another advantageous passive component is one which is non-axisymmetrically aligned with respect to the shaft. This is preferably achieved by the shaft in the vicinity of the passive component being intentionally bent or kinked.

Such a bend or kink can be such as to induce a lateral movement of the passive component towards an inside face of the borehole under the compressive forces experienced by the shaft during sliding drilling. Thus, the passive component can be forced against the inside surface during induced buckling and thus generally a high rotational frictional force.

Once the shaft starts to rotate during rotary drilling, the compressive forces experienced by the shaft are greatly reduced, enabling the shaft to straighten which can have the effect of moving the passive component away from the surface of the borehole and thus reducing or eliminating the rotational frictional force.

In a preferred embodiment, the bend or kink and the passive component can be aligned so that a particular face of the passive component is brought into contact with an inside face of the borehole. For example, a passive component with a primary sharp edge protruding significantly, from the shaft can be directed to the surface for engagement therewith.

In a second preferred embodiment, the friction inducing member comprises an active component.

For example, a suitable active component involves the variable friction inducing member comprising radially movable elements, which can be actuated to extend radially to come into contact with an inside face of the borehole. In this arrangement, the moveable elements are substantially withdrawn when the shaft in the vicinity of the friction inducing member is substantially rotating and are substantially extended when the shaft in the vicinity of the friction inducing member is substantially not rotating.

This may be achieved in a number of ways, for example the active component may comprise a centrifugal or impact-sensitive latching means, configured to allow extension of the moveable elements only when the shaft is in the vicinity of the friction inducing means is substantially not rotating.

Another possibility is to arrange for the moveable elements to be extendable over an extended period of time (e.g. from 5 to 50 seconds). During rotation, the moveable elements will occasionally impact with an inside surface of the borehole, which will have the effect of the elements being retracted by the force of the collision. Once retracted, they will only move to an extended state over a period of time, during which they provide no rotational friction.

When the shaft is substantially not rotating, the elements will become extended and connect with an inside face of the borehole. As the shaft is substantially not rotating, the elements will not receive forceful collisions and will remain extended. Thus, the active component has a high rotational friction. Such a delayed or slowed extension could, for example, be provided by porting any hydraulic actuators so they take a longer time to deploy.

In another possibility, the moveable elements may be profiled to comprise a face which is at an angle to the inside face of the borehole. During rotary drilling, when the shaft is typically rotated in a clockwise manner, the angled face will provide a gap between the angled face and the inside face of the borehole at the leading edge of the moveable element. This will have the effect of any collisions with the movable elements colliding with the exposed angled face, causing the movable element to retract, thus reducing rotational friction.

During sliding drilling, the shaft in the vicinity of the friction inducing member can rotate in either a clockwise or anti-clockwise manner due to unpredictable reactive torque. Once an anti-clockwise movement is initiated, the leading edge of the angled face will be pressed against the inside face of the borehole, and further anti-clockwise movements will cause the angled face to cut into the borehole. This provides an increased rotational friction when the shaft is substantially not rotating.

In one preferred embodiment, the present invention can be combined with the so-called "rocking" technique, as described in U.S. Pat. No. 6,050,348 or with the so-called "slider" technique, as described in U.S. Pat. No. 7,096,979. As discussed above, both of these methods involve minor rotations of the drillstring from the surface, having the effect of reducing the friction in the length of the drillstring.

Both of these techniques are effective in reducing the impeding effects of friction experienced by the shaft. Thus, by effectively reducing the friction along the vast majority of the length of the shaft, whilst also increasing the rotational friction in the vicinity of the drill bit, further improvements in control of drilling direction and weight applied to the bit, can be achieved.

In a further refinement, an automated control strategy can be implemented to provide adjustments to the drilling operation in order to maintain a desired drilling direction and/or weight on bit. A number of measurable parameters are available, such as top drive or hook position, hook load, stand pipe or pump pressure, tool face measured down hole, rotary position of the drillstring in the top drive, and in some cases the down hole weight-on-bit and torque.

Such a control strategy could implement a number of submodels, including elastic weight transfer from the movement of the top drive to the weight-on-bit, weight-on-bit correlation to torque at the drill bit, torque reaction through the motor to pressure drop so that pump pressure can be used as a measure of drilling torque, and the elastic twist of the drillstring.

In an aspect of the present invention, a method for torsional stabilizing a directional drilling system, including a rotatable shaft at the leading end of which is a drill bit, for drilling a borehole through an Earth formation, is provided the method comprising:

activating a downhole motor in the borehole to rotate the drill bit; and extending one or more moveable elements from the drillstring to contact an inner-wall of the borehole and generate a torque friction.

BRIEF DESCRIPTION OF THE DRAWINGS

In the figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

The invention will now be illustrated, with reference to the following figures, in which.

DETAILED DESCRIPTION

Figure 1A:
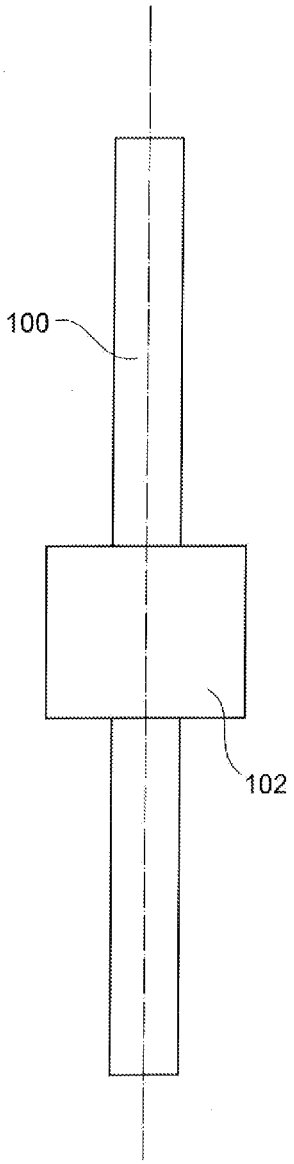
FIGS. 1(*a*)-(*f*) provide schematic representations of passive variable friction inducing members, according to embodiments of the present invention.
Figure 1B:
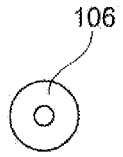
Figure 1C:
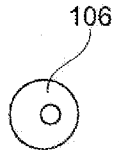
Figure 1D:
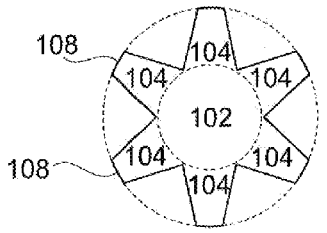
Figure 1E:
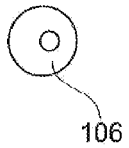
Figure 1F:
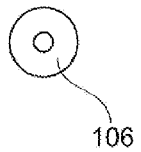

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention. It being understood that various changes may be made in the function and arrangement of elements without departing from the scope of the invention as set forth herein.

Specific details are given in the following description to provide a thorough understanding of the embodiments. However, it will be understood by one of ordinary skill in the art that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

Turning to the figures, FIG. 1 shows a shaft 100 of a drillstring in the vicinity of a passive variable friction inducing member 102. The left hand side of FIG. 1 shows a side view of the shaft 100, and the right hand side shows the cross-sectional plan views at their respective positions in the shaft 100.

The passive member 102 is generally cylindrical, with a diameter greater than that of shaft 100, but less than that of the drilled borehole (not shown). The passive member 102 comprises cut-aways into the body of the cylinder, to produce a number of fins 104. It can be seen that each fin 104 comprises two sharp longitudinal edges, which can connect with an inside face of the borehole.

The passive component 102 is surrounded on both sides of the shaft by positional collars 106. These collars comprise a hole off-set to the right of FIG. 1.

During a sliding drilling operation, the shaft 100 experiences significant compressional strain. The off-set collars 106 induce a buckling of the shaft 100 in a direction to the left in FIG. 1. This has the effect of moving the passive component 102 to the left until its two sharp longitudinal edges 108 contact an inside face of the borehole.

The large spacing between edges 108 allows one or both of them to cut into the inside face of the borehole. As sliding drilling continues, any reactive torque transmitted from the drill bit to the passive component 102 will cause one or both of the edges 108 to cut deeper into the inside face of the borehole, thus preventing or greatly reducing any rotation of the shaft 100.

Thus, the reactive torque can only act on the shaft 100 between the passive component and the drill bit. As this length is much less than the total length of the drillstring, the ability of the drill bit to deviate from its target direction is restricted.

Once rotary drilling is resumed the compressive forces on the shaft 100 will be reduced as the friction along the length of the drillstring reduces. This, combined with the rotational movement, causes the passive component to move to a central position, when it can freely rotate without contacting an inside face of the borehole. Thus, the rotational frictional force is greatly reduced and rotary drilling can continue unhindered.

Figure 2A:
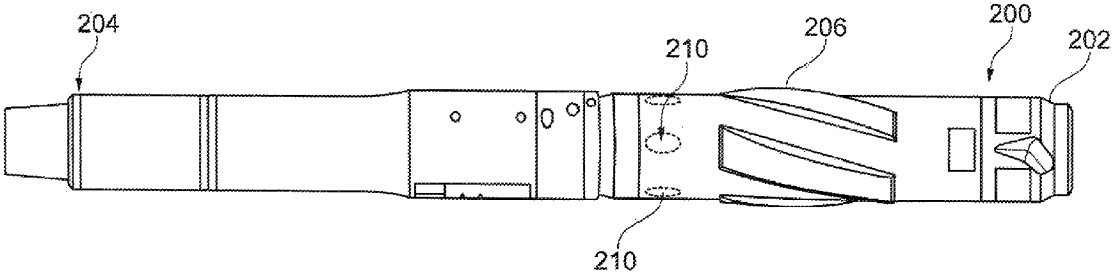
FIGS. 2A and 2B provide two images of the bottomhole apparatus 200 of a drillstring, according to an embodiment of the present invention.
Figure 2B:
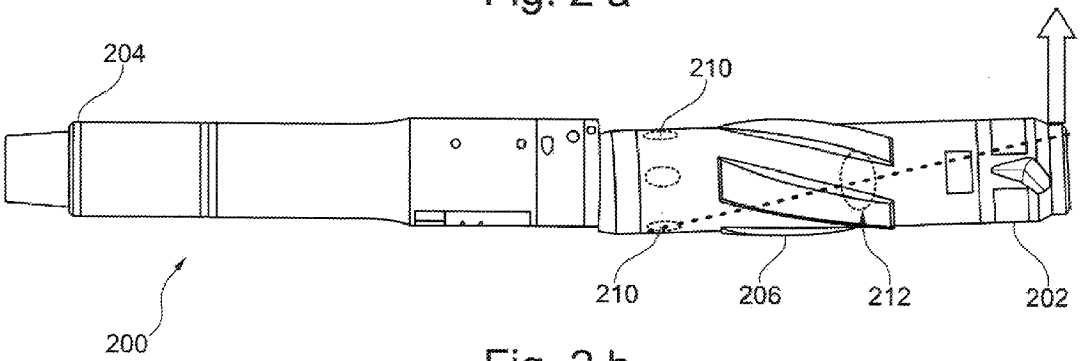

FIG. 2 shows two images of the bottomhole apparatus 200 of a drillstring.

The bottomhole apparatus 200 comprises a drill bit 202, a rotary valve 204 and a directional drilling section 206. The directional drilling section 206 also comprises a variable friction inducing member 208, according to the present invention.

The variable friction inducing members 208 comprises a number of moveable elements 210 and are shown in their withdrawn state in the figure.

During rotational drilling, as shown in the uppermost figure, the directional drilling section 206 is aligned with the bottomhole apparatus and the moveable elements 210 are withdrawn. When it is desired to initiate directional drilling, or sliding drilling, rotation is stopped and a portion of the drilling mud is diverted to pistons in the directional drilling section 206. This causes its alignment to deviate from that of the bottomhole apparatus. This is facilitated by the use of a universal joint 212, internal to the directional drilling section 206.

At the same time, the moveable elements 210 are extended so that they engage with an inside face of the borehole.

As sliding drilling commences, the increased friction induced by the moveable members 210, helps to prevent the directional drilling section 206 deviating from the target direction.

In an embodiment of the present invention, a torsional stabilizer may be used in a directional drilling system, the directional drilling system including a rotatable shaft at the leading end of which is a drill bit and designed for drilling a borehole through an Earth formation. In an embodiment of the present invention, the torsional stabilizer may comprise a drilling section for coupling with the directional drilling system and one or more moveable elements 210 coupled with the drilling section and configured to rotate with a rotation of the rotatable shaft, wherein the moveable elements 210 are configured to extend from the drilling section and provide a rotational friction by physical contact with an inside face of the borehole, the moveable elements 210 being arranged to exert a first rotational frictional force when the shaft in the vicinity of the moveable elements is substantially rotating and a second rotational frictional force when the shaft in the vicinity of the moveable elements is substantially not rotating or rotating in an opposite direction, wherein the first rotational frictional force is less than the second rotational frictional force.

In an embodiment of the present invention, the moveable elements 210 may have an active and a passive state. The moveable elements 210 may be in the passive state when the drillstring is rotated in the borehole by a top drive system or the like at the surface in a forward direction. The moveable elements 210 may be in the active state when the drillstring is not rotated by a surface drive mechanism so that the drillstring is not rotating or when the drillstring is rotating in a backward direction as a result of an interaction between a downhole motor and the drillstring. In an embodiment of the present invention, the drilling section and the moveable elements 210 may be positioned on the drillstring above the downhole motor such that the downhole motor is between the drilling section and the moveable elements 210 and the drill bit.

In an embodiment of the present invention, the passive state may be one in which the moveable elements 210 are not extended from the drilling section when the drillstring rotates in the forward direction, are not locked on the drilling section such that they are pushed—are passive—towards the drilling section by rotation of the drillstring in the forward direction, are flexible with respect to rotation of the drillstring in the forward direction and/or the like.

In an embodiment of the present invention, the active state may be one in which the moveable elements 210 extend from the drilling section when the drillstring rotates in the backward direction, are locked on the drilling section such that they are pushed into contact with the inner-wall of the borehole by rotation of the drillstring in the backward direction, are not flexible but are driven into contact with the inner-wall of the borehole with respect to rotation of the drillstring in the backward direction and/or the like.

In an embodiment of the present invention, the moveable elements 210 produce only a small frictional contact with the inner-wall of the borehole when the drillstring is rotated by a drive mechanism at the surface of the Earth formation being drilled. For purposes of clarity this driven drilling direction is referred to as the forward direction. In an embodiment of the present invention, when the forward rotation ceases or an opposite rotation of the drillstring occurs, referred to for clarity as a backward rotation, the moveable elements 210 produce a large frictional contact with the inner-wall. This large frictional contact may be produced by the moveable elements 210 extending from the drillstring, locking into position on the drillstring, having a rigidity with regard to backward rotation and/or the like. Backward rotation of the drillstring may be caused by use of a downhole motor for driving the bit during slip drilling.

In an embodiment of the present invention, to provide for the change between the active and passive states of the moveable elements 210, the moveable elements 210 may be spring loaded to the drilling section so that the one or more moveable elements 210 extend and engage the inside face of the borehole when the shaft in the vicinity of the moveable elements 210 is substantially not rotating or rotating in a backwards direction.

In an embodiment of the present invention, to provide for the change between the active and passive states of the moveable elements 210, the moveable elements 210 may be latched to the shaft using a centrifugal or impact latch to provide that the one or more moveable elements 210 extend and engage the inside face of the borehole when the shaft in the vicinity of the moveable elements 210 is substantially not rotating or rotating in a backwards direction.

In an embodiment of the present invention, to provide for the change between the active and passive states of the moveable elements 210, the moveable elements 210 may be actuated by a motor that may provide for extending and retracting the one or more moveable elements 210, the motor being configured to extend the one or more moveable elements 210 to engage the inside face of the borehole when the shaft in the vicinity of the moveable elements 210 is substantially not rotating or rotating in a backwards direction. The motor may comprise the downhole motor and/or may be a hydraulic motor, diverter or the like that may use the drilling mud circulating in the drilling system to control the moveable elements 210.

In an embodiment of the present invention, to provide for the change between the active and passive states of the moveable elements 210, the moveable elements 210 may be profiled such that the one or more moveable elements 210 retract when the rotatable shaft is rotated in a forward direction and the one or more moveable elements 210 extend and lock into position when rotation of the rotatable shaft is reversed.

Figure 3:
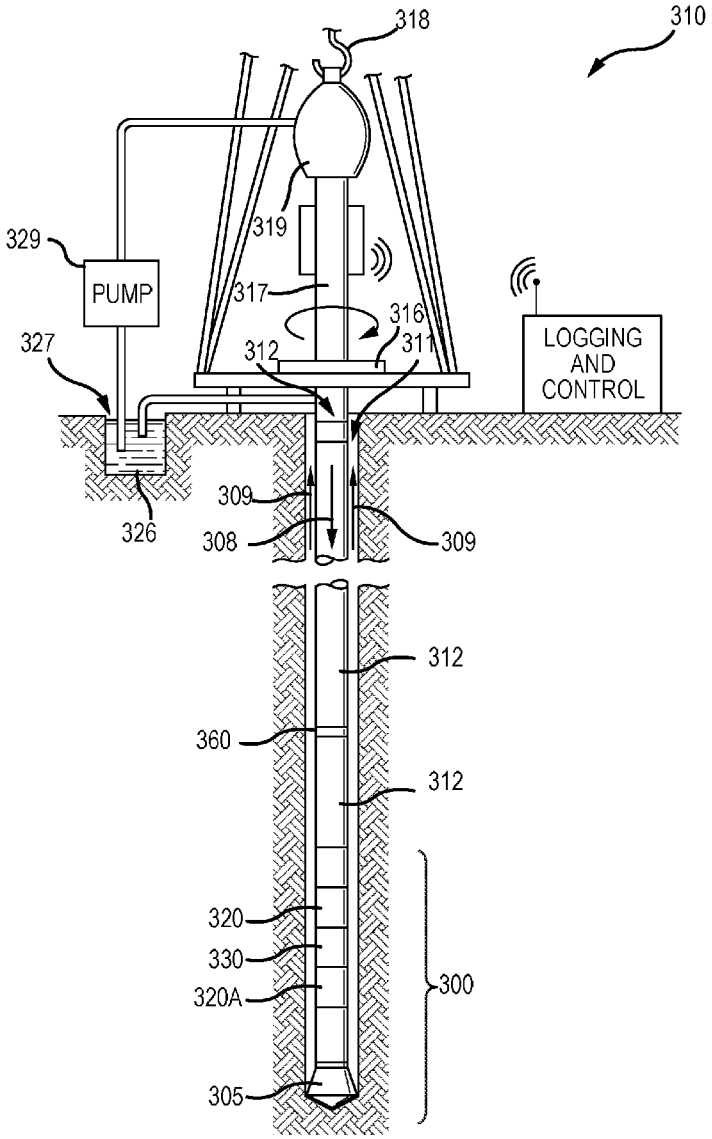
FIG. 3 is a schematic representation of an underground drilling operation, in accordance with an embodiment of the present invention.

FIG. 3 illustrates a well site system including a friction inducing member, in accordance with an embodiment of the present invention. The well site can be located onshore or offshore. In this exemplary system, a borehole 311 is formed in subsurface formations by rotary drilling in a manner that is well known. Embodiments of the invention can also use be used in directional drilling systems, pilot hole drilling systems, cased drilling systems, coiled tubing drilling systems and/or the like.

A drillstring 312 is suspended within the borehole 311 and has a bottomhole assembly 300 which includes a drill bit 305 at its lower end. The surface system includes a platform and derrick assembly 310 positioned over the borehole 311, the assembly 310 including a rotary table 316, kelly 317, hook 318 and rotary swivel 319. The drillstring 312 is rotated by the rotary table 316, energized by means not shown, which engages the kelly 317 at the upper end of the drillstring. The drillstring 312 is suspended from a hook 318, attached to a traveling block (also not shown), through the kelly 317 and the rotary swivel 319 which permits rotation of the drillstring relative to the hook. As is well known, a top drive system could alternatively be used.

In the example of this embodiment, the surface system further includes drilling fluid or mud 326 stored in a pit 327 formed at the well site. A pump 329 delivers the drilling fluid 326 to the interior of the drillstring 312 via a port in the swivel 319, causing the drilling fluid to flow downwardly through the drillstring 312 as indicated by the directional arrow 308. The drilling fluid exits the drillstring 312 via ports in the drill bit 305, and then circulates upwardly through the annulus region between the outside of the drillstring and the wall of the borehole, as indicated by the directional arrows 309. In this well known manner, the drilling fluid lubricates the drill bit 305 and carries formation cuttings up to the surface as it is returned to the pit 327 for recirculation.

The bottomhole assembly 300 of the illustrated embodiment may include a logging-while-drilling (LWD) module 320, a measuring-while-drilling (MWD) module 330, a rotary-steerable system and motor, and drill bit 305.

The LWD module 320 may housed in a special type of drill collar, as is known in the art, and can contain one or a plurality of known types of logging tools. It will also be understood that more than one LWD and/or MWD module can be employed, e.g. as represented at 320A. The LWD module may include capabilities for measuring, processing, and storing information, as well as for communicating with the surface equipment. In one embodiment, the LWD module may include a fluid sampling device.

The MWD module 330 may also housed in a special type of drill collar, as is known in the art, and can contain one or more devices for measuring characteristics of the drillstring and drill bit. The MWD tool may further includes an apparatus (not shown) for generating electrical power to the downhole system. This may typically include a mud turbine generator powered by the flow of the drilling fluid, it being understood that other power and/or battery systems may be employed. In one embodiment, the MWD module may includes one or more of the following types of measuring devices: a weight-on-bit measuring device, a torque measuring device, a vibration measuring device, a shock measuring device, a stick slip measuring device, a direction measuring device, and an inclination measuring device.

In an embodiment of the present invention, an orienter 360, may be coupled with the drillstring 312, the bottomhole assembly 300 and/or the like.

In the case where coiled tubing is employed, it is not generally possible to rotate the drillstring 312 as described above. Instead a mud motor is provided as part of the drillstring to provide power to rotate the drill bit 305.

The friction inducing member according to the present invention will be located as an integral component of the bottomhole assembly 300, or in the vicinity of the orienter 360.

While the principles of the disclosure have been described above in connection with specific apparatuses and methods, it is to be clearly understood that this description is made only by way of example and not as limitation on the scope of the invention.

The invention claimed is:

1. A method for drilling a borehole through an earth formation with a drilling system comprising:

a drillstring comprising a rotatable shaft at the leading end of which is a drill bit;

a drive coupled with the upper end of the drillstring and configured to rotate the drillstring in the borehole:

a variable friction inducing member coupled with the drillstring wherein the variable friction inducing member comprises a plurality of extendable elements disposed around the drillstring circumference and configured in use to provide a rotational friction by physical contact with an inside face of the borehole, wherein the friction inducing member is arranged to exert a first rotational frictional force when the shaft in the vicinity of the member is substantially rotating and a second rotational frictional force when the shaft in the vicinity of the member is substantially not rotating, wherein the first rotational frictional force is less than the second rotational frictional force; and a downhole motor coupled with the drillstring between the variable friction inducing member and the drill bit and configured for rotating the drill bit, the method comprising periods of rotating the drillstring with the drive at the surface during which the extendable elements of the friction inducing member are retracted so that the friction inducing member exerts the first rotational frictional force, and periods of rotating the drill bit with the downhole motor while the drillstring is substantially not rotating and the extendable elements are extended and the friction inducing member exerts the second rotational frictional force.

2. The method according to claim 1, wherein the ratio of the second frictional force to the first frictional force is at least 2:1.

3. The method according to claim 1, wherein the friction inducing member is less than 500 m from the drill bit.

4. The method according to claim 1, wherein the downhole motor comprises a hydraulic motor.

5. The method according to claim 1 wherein the drive at the upper end of the drillstring is a top drive.

6. A method for torsional stabilizing a directional drilling system, including a rotatable drillstring at the leading end of which is a drill bit, for drilling a borehole through an Earth formation, the method comprising:

periodically, while the drillstring is substantially not rotating, activating a downhole motor in the borehole to rotate the drill bit and extending a plurality of moveable elements from the drillstring to contact an inner-wall of the borehole and generate a torque friction in response to the activation of the downhole motor, wherein the plurality of moveable elements are arranged around the drillstring circumference, and wherein the plurality of moveable elements are extended simultaneously with the activation of the downhole motor.

7. A method for torsional stabilizing a directional drilling system, including a rotatable drillstring at the leading end of which is a drill bit, for drilling a borehole through an Earth formation, the method comprising:

periodically, while the drillstring is substantially not rotating, activating a downhole motor in the borehole to rotate the drill bit and extending a variable friction inducing member comprising a plurality of moveable elements from the drillstring to contact an inner-wall of the borehole and generate a torque friction in response to the activation of the downhole motor, wherein the plurality of moveable elements are disposed around the drillstring circumference and the method comprises extending the movable elements from the drillstring when the downhole motor is activated and retracting the plurality of moveable elements when the downhole motor is inactive.

* * * * *